US009956437B2

(12) United States Patent
Colorado

(10) Patent No.: US 9,956,437 B2
(45) Date of Patent: May 1, 2018

(54) AUTO BRAKE HAND DESCENT CONTROL DEVICE

(71) Applicant: FIRE INNOVATIONS LLC, Petaluma, CA (US)

(72) Inventor: Juancarlos Colorado, Petaluma, CA (US)

(73) Assignee: Fire Innovations LLC, Petaluma, CA (US)

( * ) Notice: Subject to any disclaimer, the term of this patent is extended or adjusted under 35 U.S.C. 154(b) by 0 days. days.

(21) Appl. No.: 15/463,572

(22) Filed: Mar. 20, 2017

(65) Prior Publication Data

US 2017/0266471 A1 Sep. 21, 2017

Related U.S. Application Data

(60) Provisional application No. 62/310,580, filed on Mar. 18, 2016.

(51) Int. Cl.
*A62B 1/14* (2006.01)

(52) U.S. Cl.
CPC ..... *A62B 1/14* (2013.01)

(58) Field of Classification Search
CPC ..... A62B 1/14
See application file for complete search history.

(56) References Cited

U.S. PATENT DOCUMENTS 327,111 A * 9/1885 Robinson ..... A62B 1/14 182/193
340,239 A * 4/1886 Palmer ..... F16G 11/00 24/129 R
8,398,687 B2 * 3/2013 Vasta ..... A61B 17/8061 606/284
8,925,680 B2 1/2015 Herrli
2004/0167522 A1 * 8/2004 Niederberger ..... A61B 17/8057 606/286
2012/0012422 A1 * 1/2012 Herrli ..... A62B 1/14 182/5
2012/0065731 A1 * 3/2012 Justin ..... A61B 17/0487 623/13.14

FOREIGN PATENT DOCUMENTS

WO WO 2014019273 A1 * 2/2014 ..... A62B 1/14

* cited by examiner

*Primary Examiner* — Alvin C Chin-Shue
(74) *Attorney, Agent, or Firm* — Craig M. Stainbrook; Stainbrook & Stainbrook, LLP

(57) ABSTRACT

A descent control device to facilitate rapid descent and abseil (rappelling) maneuvers, including a body, a handle integrally affixed to the body to define a longitudinal axis for the device, an attachment lug disposed on the body, and a combination of through holes through the body through which a safety line is threadably inserted in a specific pattern, and shallow channels between the through holes, thereby giving rise to configurations that allow the safety line to payout freely through the descent device, to be locked in relation to the descent device, or to payout in a controlled pace, all configurations depending on the orientation of the longitudinal axis of the device to the anchored upper portion of the safety line.

14 Claims, 5 Drawing Sheets

AUTO BRAKE HAND DESCENT CONTROL DEVICE

CROSS-REFERENCE TO RELATED PATENT APPLICATIONS

The present application claims the benefit of U.S. Provisional Patent Application Ser. No. 62/310,580 filed Mar. 18, 2016, which is incorporated in its entirety by reference herein.

FIELD OF THE INVENTION

The present relates most generally to a descent control device to facilitate rapid descent and abseil (rappelling) maneuvers, and more particularly to a descent control device for use in either recreational or emergency abseil use, and still more particularly to a descent device specifically adapted for emergency rapid escape from a dangerous environment encountered by emergency first responders, firefighters, and military or law enforcement personnel.

BACKGROUND DISCUSSION

Emergency rescue personnel (principally firefighters, and military and law enforcement personnel) may encounter conditions requiring a very rapid egress from a building or other structure at height. When trapped in a structure above ground level and in urgent need of getting to ground, but when having no reasonable means to descend to ground level in a customary manner (stairs, elevators, and the like), it is desirable to have equipment that provides for a safe descent in a non-customary manner—such as by jumping from a window. To be able to do so safely in urgent circumstances is an answer to prayer; to have those prayers answered in advance is the object of the present invention.

In principle, all descent control devices (aka "descenders") use friction in one or another manner to control the rate of descent when using a rope to lower equipment or people. Broadly, there are two categories of descenders, namely variable friction and fixed friction, and three types: (1) figure eights, a fixed friction device commonly used for short drops and use in bottom belays, but prone to put kinks and twists in rope; (2) racks, which are variable friction devices which resemble a miniature ladder, most useful for very long descents but significantly bulkier and heavier than figure eights and thus not well suited for emergency use by first responders; and (3) bobbins, almost universally associated with popularized by its French caving gear producer, Petzl. Bobbins are constant friction descenders using bollards over which rope is threaded in a sinuous pattern to create a friction angle of about 480°. Newer models may include a rope brake that can be actuated to apply stopping force friction during a descent. Belay plates and Munter hitches are also popular. There are basically three types of descent devices:

Type 1—Hand Brake/Hand Control Descent: User must hold onto the rope with this device to brake and to control their decent. If not, they will fall to the ground.

Type 2—Auto Brake/Hand Control Descent: User does not need to hold onto the device when exiting a window, the device will auto brake for them. When the device is manipulated in some fashion via a lever or motion, the rope will be free to move depending on the user controlling the rope release.

Type 3—Auto Brake/Auto Control Descent: User does not need to hold onto device when exiting a window, the device will break for them. The device can be also set to descend at a set rate of speed, no need for the user to control the rope.

The present invention (which bears the proprietary name of the "Core") is a Type 2 Auto Brake/Hand Control Device. It is an auto braking descent device that brakes without any help from the user. The unique feature of the Core is that it does not use any moving parts to make the auto breaking work. The absence of moving parts prevents damage and operational failure in the presence of debris, dirt, sand, or other potential impediments are present, such as are commonly found in firefighter and military activities and environments. It is the first to use gravity alone—i.e., the user's weight and threading of the rope into the device—to accomplish the auto breaking.

Auto Brake/Hand Control Devices are popular among firefighters because firefighters were heavy protective firefighter gloves and are often unable to feel and locate the free end of the rope during an emergency exit. This is because firefighter gloves are bulky and lack flexibility, and dramatically decrease tactile awareness. Also, the inability to see clearly through a safety facemask, such as those worn by firefighters, limits the ability the see and to easily find and use the free end of the rope. Time is short in emergency situations, and just getting an anchor established is the only action one can accomplish prior to making an emergency jump from a window or roof. The Core catches the firefighter (stops freefall) once out the window, and the firefighter can then locate the handle and control the descent. Once out of the hazardous environment, the firefighter can locate the free end of the rope and manipulate the Core to complete a descent.

Military personnel encounter similar problems, particularly when lowering from a helicopter and under fire. The Core will not allow a user to fall to the ground if wounded and disabled, and the user can thus be flown to a safer location. Again, the absence of failure-prone moving parts allows for a higher degree of safety. In contrast, when using a Type 1 descent device, the user would simply fall to the ground. And Type 3 devices are simply large, costly, and have several failure-prone moving parts that jam with debris.

Existing descenders work sufficiently well in most commercial and recreational applications. But for the emergency first responder, an extremely high quality descent control device is required. This is particularly true because when intended for use by firefighters, descent control devices must meet extremely stringent standards set by the National Fire Protection Association ("NFPA"). Specifically, the NFPA 1983 (amended 2012) Escape "E" standards for Descent Control Device Performance Requirements of 3 σ MBS of not less than 13.5 kN (3,034 lbf). Under a load test, the descent control device must not allow rope to slide through the device when locked off under a load of 300+ lbs. However, when the user wishes for rope to be paid out, when rope is released for free payout, the payout must occur at less than 20 lbs of applied force. NFPA 1983 standards also require that ropes must have strength, static, and stretch characteristics that will not allow them to break under a tensile load of 3,000 lbs, and many descent control devices will actually cause rope failure under such tensile loads.

The present invention is a descent control device that meets and exceeds all NFPA 1983 standards for descent control hardware. It is lightweight, simple to use, self-righting, absolutely reliable, and perfectly adapted for firefighters, rescuers, and military and law enforcement personnel. Importantly, the descender is exceedingly simple to use, intuitive in every respect, and as a critical safety component is configured to immediately lock upon release when under load. When not under load, rope properly threaded through the hole configuration easily pays out horizontally, when, for instance, a firefighter is mapping a path through a smoke-filled structure using a tethered safety line.

DETAILED DESCRIPTION OF THE INVENTION

Figure 1:
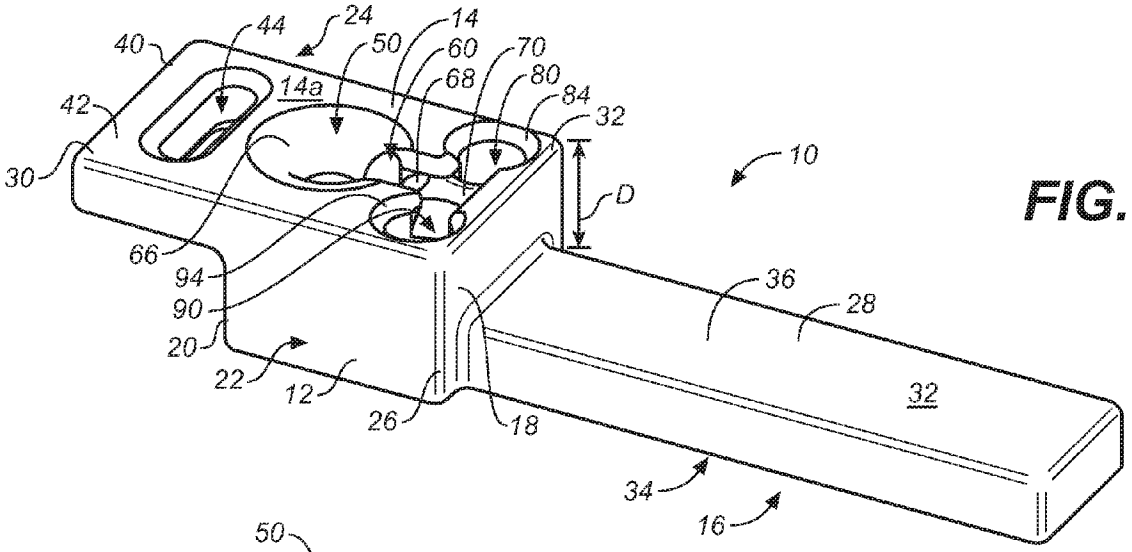
FIG. 1 is an upper perspective view showing the descent control device of the present invention.
Figure 2:
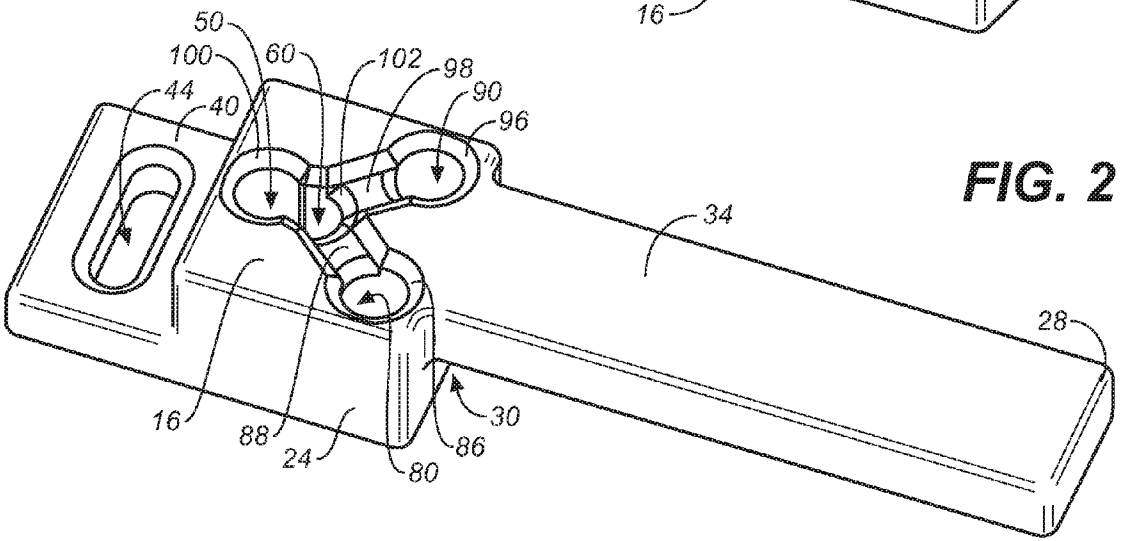
FIG. 2 is a lower perspective view thereof.

The descent device (descender) of the present invention 10 includes a body 12 having an outer side 14 (which faces away from user when in use, meaning when bearing a load) and an inner side 16 (which faces a user when in use). The body further includes an upper (superior) side 18 (generally oriented in a superior position when in use), a lower (inferior) side 20 (generally oriented in an inferior position when in use), a left side 22, and a right side 24.

Integrally affixed to and extending from an inner portion 26 of the upper side 18 of the body 12 is a handle (or bar) 28 for gripping by a user. A rope clearance space for creating a gap or clearance between a climbing rope and the handle when a load is suspended is created by the distance D from the upper edge 30 of the upper portion 32 of the body 12 to the outer side 34 of the handle. The inner side 36 of the handle may be flat and is generally coplanar with the surface 14*a* of the inner side 14 of the body 12.

The body next includes an attachment lug 40 integral with an outer portion of the lower side 20 of the body 12. The upper surface 42 of the attachment lug may be coplanar with the outer surface 14*a* of the outer side 14 of the body 12. The attachment lug 42 includes a slot or hole 44 for passing a rope or lanyard, which is then employed to couple the descender to a user's climbing harness or belt.

Figure 3:
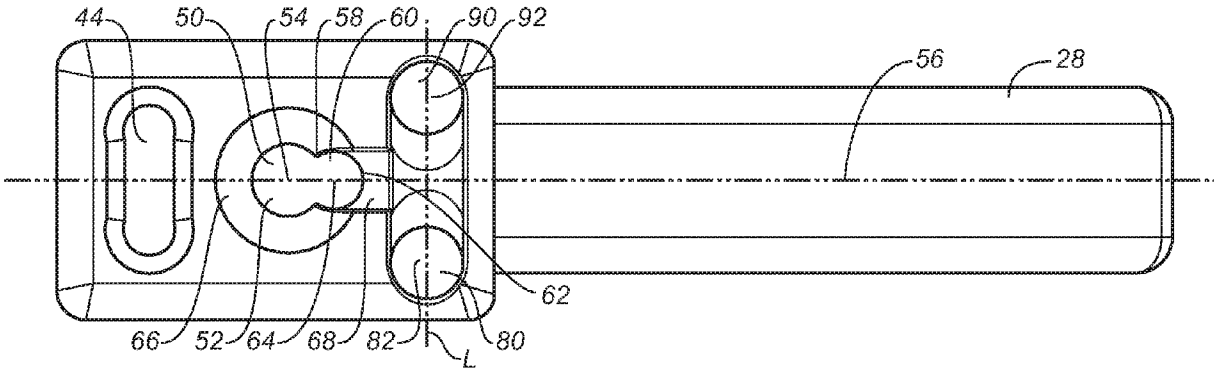
FIG. 3 is a top plan view thereof (showing the outer side of the descender body)
Figure 4:
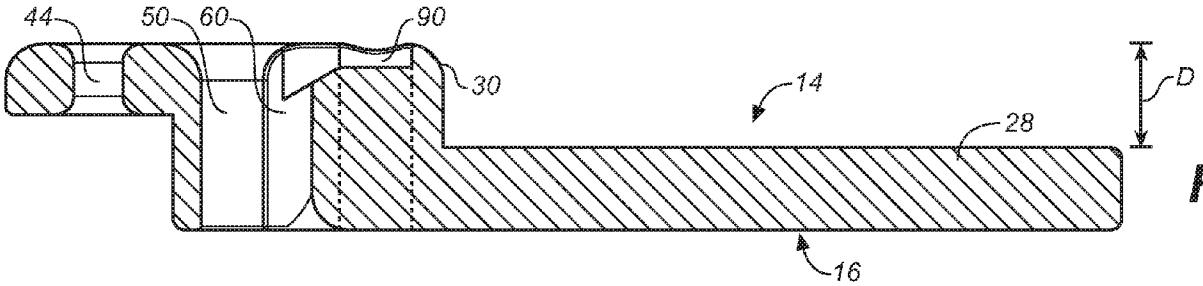
FIG. 4 is a side view in elevation thereof.
Figure 5:
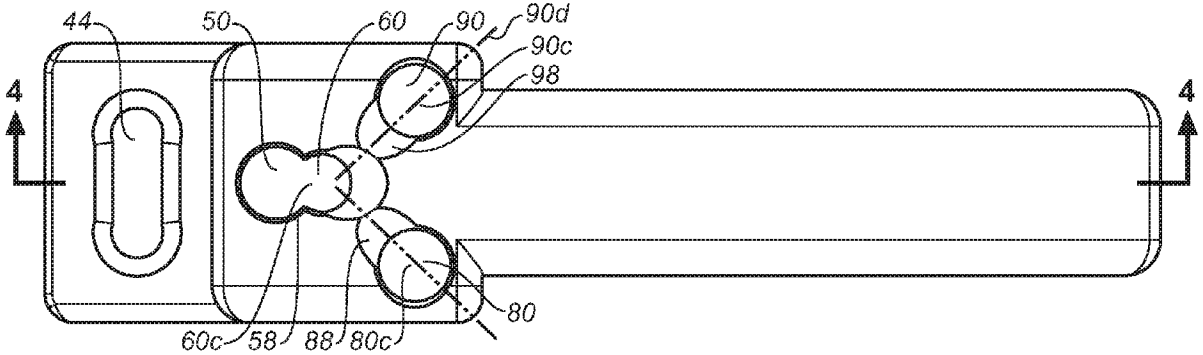
FIG. 5 is a bottom plan view thereof (showing the inner side of the descender body)

The body next includes a set of through holes, each passing from the upper side to the lower side of the descender body with the respective axes of the holes each oriented generally normal to the inner and outer sides, and thus parallel to one another. The holes include a payout hole 50 having a diameter 52 and a central axis 54 located on the longitudinal axis 56 of the descender. Conjoined to an upper portion 58 of the payout hole is an anchor hole 60 having a diameter 62 smaller than that of the payout hole and a central axis 64 also located on the longitudinal axis of the descender. Looked at from the top and bottom plan views (FIGS. 3 and 5 respectively), wherein the broken circumference of each of the payout and anchor hole in the descender body side can be seen, the conjunction or intersection of the payout hole and the anchor hole comprises roughly 90 (+/−30 degrees) of arc of the payout hole and 150 (+/−30) degrees of arc of the anchor hole. The central axis of the anchor hole is oriented parallel to the central axis 54 of the payout hole 50.

Figure 10:
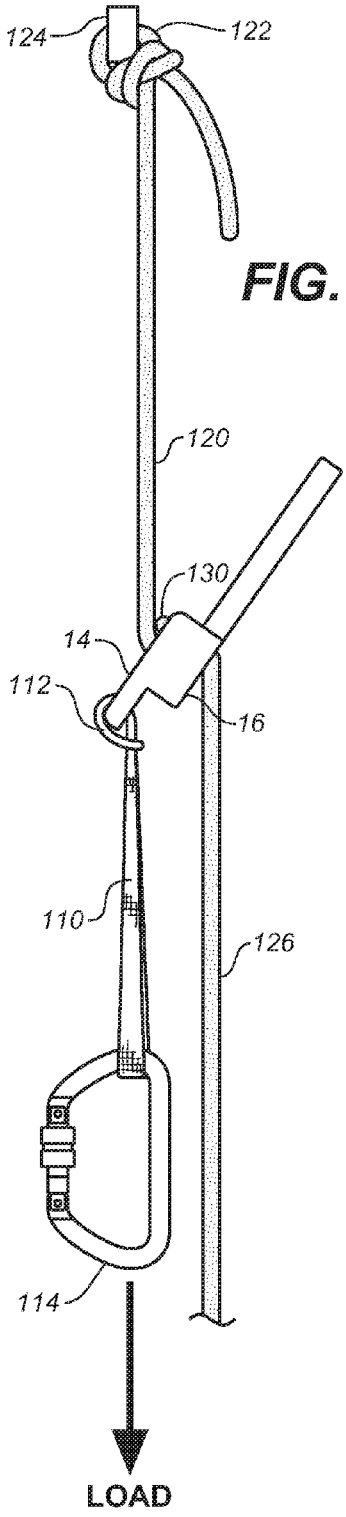
FIG. 10 shows the descender device in use in a braking configuration.

Surrounding the payout hole on the outer side 14 of the descender body 12 is a chamfered opening 66 that provides a surface for inducing a gentle bend in rope disposed through the payout hole. Similarly, the upper end of the anchor hole includes a chamfered opening 68 that terminates in an arcuate shelf 70 formed at a depth from the surface 14*a* of the outer side 14 of the descender body 12, such that rope sized for use in the descender will bend proud across the shelf in relation to the surface 14*a* of the outer side 14. These features are described in more detail below and may be appreciated by reference also to FIGS. 8-10.

Right and left holes 80, 90, respectively, are disposed through the descender body, each having a central axis 82, 92 normal to the longitudinal axis 56 of the body. Right and left holes each include a chamfered upper opening 84, 94 to induce gentle bends in rope.

Right and left holes 80, 90, have chamfered lower openings 86, 96, at the outer side 16 of the descender body 12. Disposed between each of the left and right holes and the anchor hole 60 on the inner side of the descender body are shallow channels 88, 98 to accept and constrain a rope segment bent proud between one or the other side holes and the anchor/payout hole. The shallow channels are, respectively, longitudinally aligned with a line 80*d*, 90*d*, drawn between the center of the right and left holes 80*c*, 90*c*, and the center of the anchor hole 60*c*. Payout hole 50 and anchor hole 60 each have chamfered outer openings, 100, 102, respectively.

Figure 6:
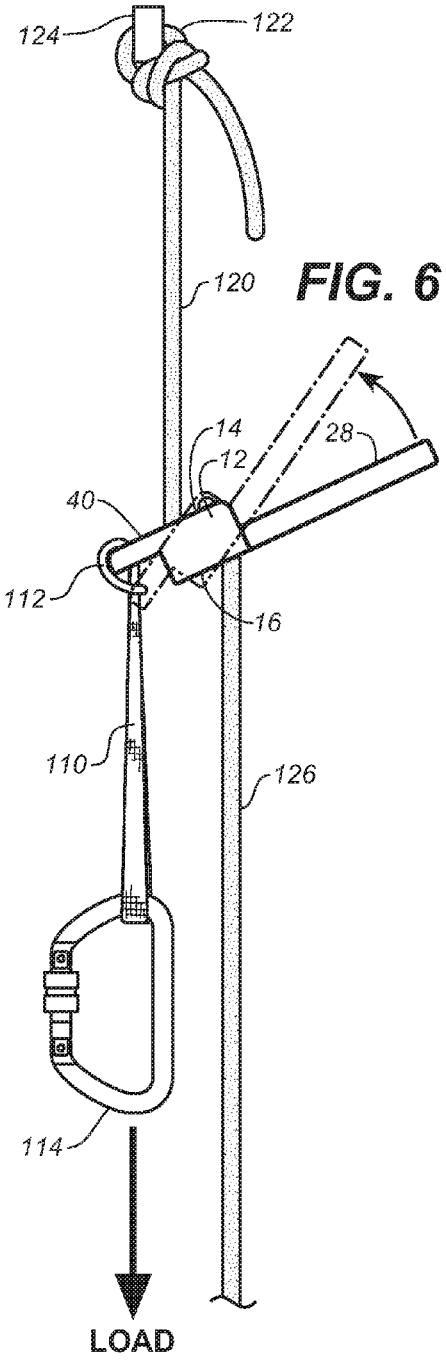
FIG. 6 is a side view in elevation showing the inventive descent control device installed on a climbing rope with a lanyard attached on one end to the attachment ring of the descender and a carabiner on the other end for attachment to a climbing belt D-ring, the rope and descender shown here in a payout configuration.

Referring next at FIG. 6, the descender device is shown set up for use in a rappel/descent operation. In such use, an attachment lanyard (a loop of Kevlar strap) 110 is attached at one end to lug 40 using a cow (or Larks foot or Girth) hitch 112. A carabiner 114 is attached to another end. A climbing belay/rappelling rope 120 is connected at an upper end 122 to an anchoring device 124. The free end 126 is threaded through the through-holes in the descender body in a specific pattern, described below. The carabiner is attached to the user's climbing harness or belt at a tie in loop or D-ring.

Figure 7:
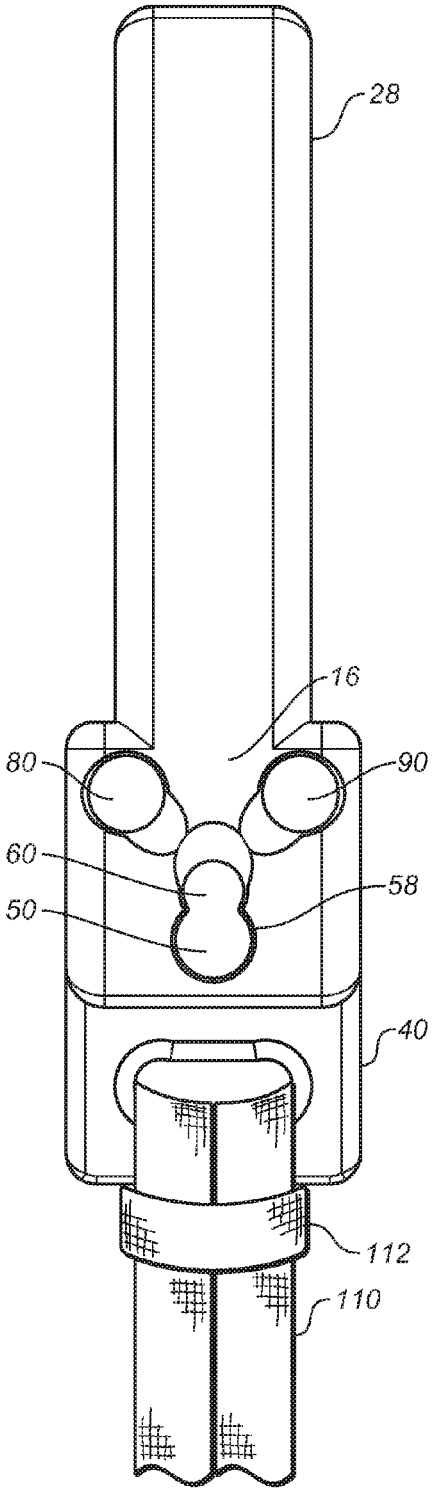
FIG. 7 is a perspective view of the underside (also user-facing side) of the descender showing the hole configuration.
Figure 9:
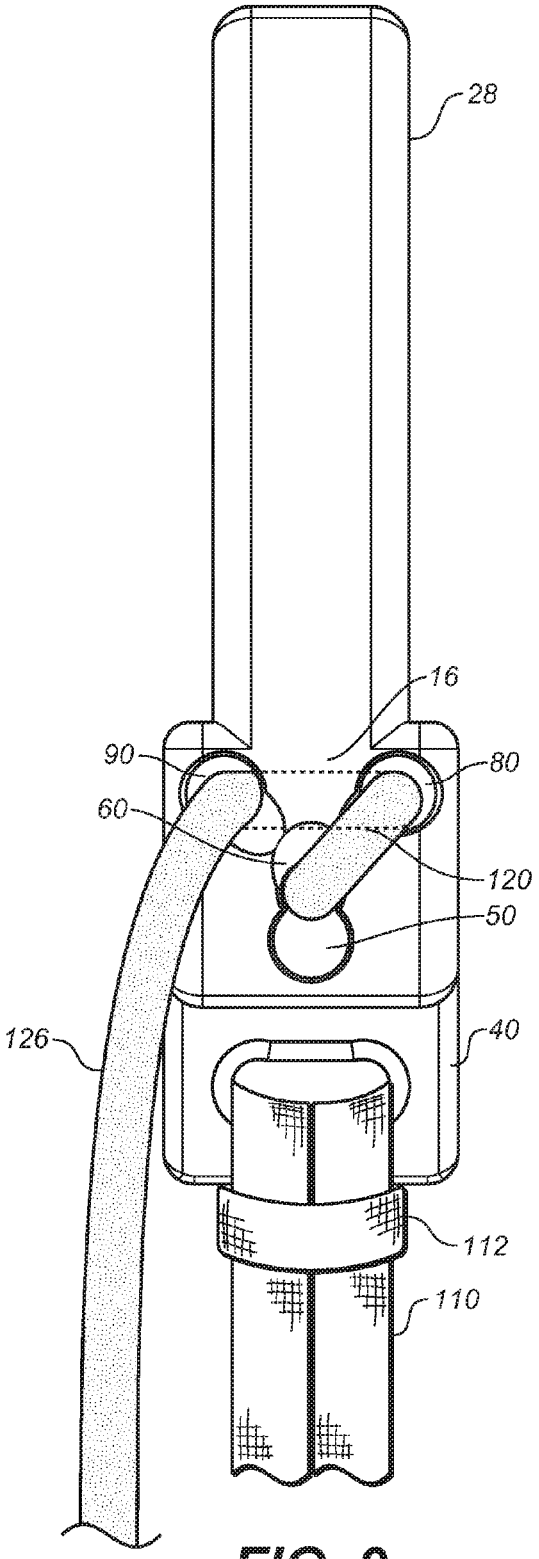
FIG. 9 is a lower perspective view showing details of the same rope threading pattern as seen from the underside (user-facing side) of the device.
Figure 8:
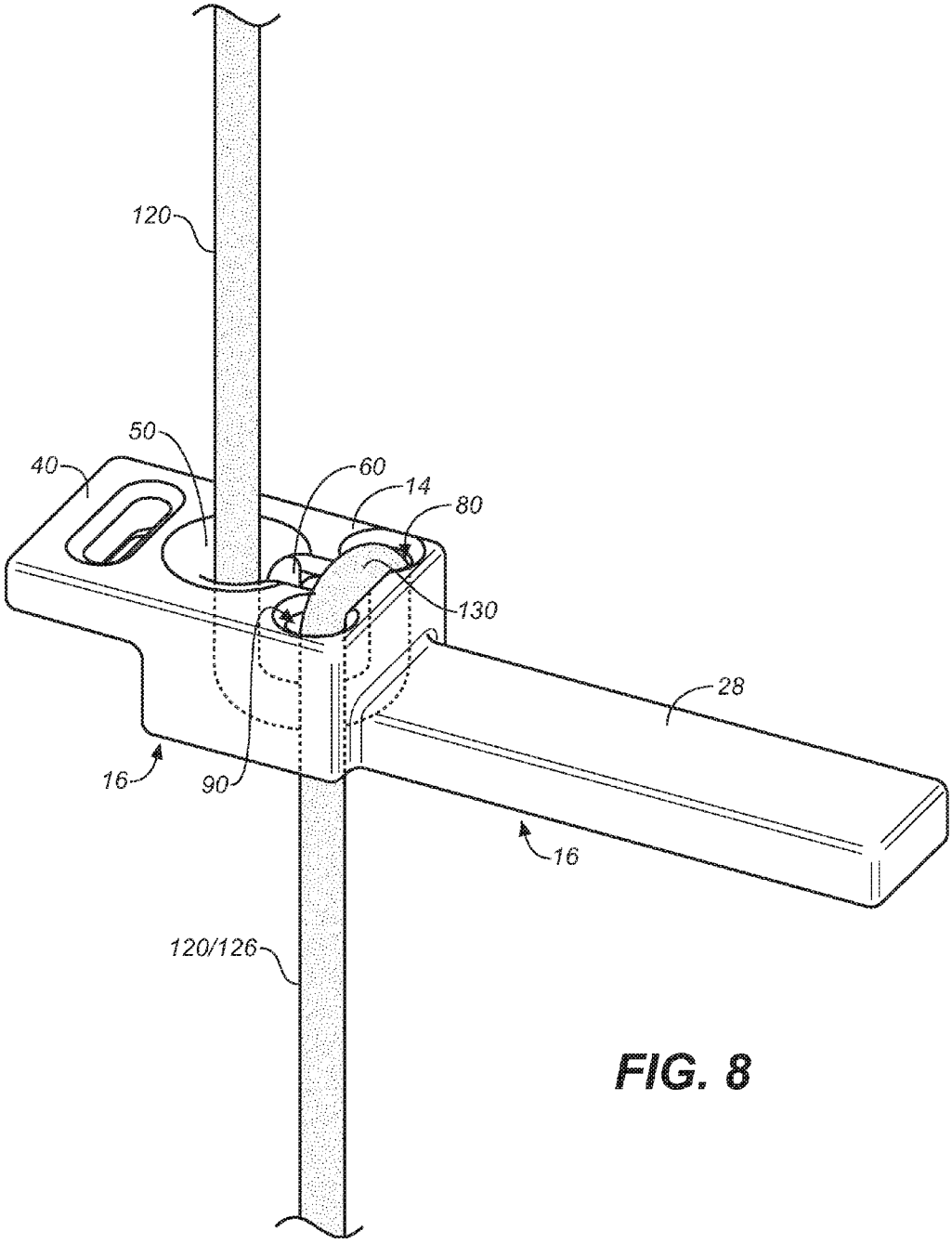
FIG. 8 is an upper perspective side views showing details of the rope wrapping/threading pattern used for controlled descents.

Referring now to FIGS. 7-9, there is shown the threading pattern for passing a safety line or rope through the through-holes that enables a user to selectively lock or pay out safety line in a controlled manner when executing a descent. Before attachment to an anchoring device, the rope upper (anchoring) end is passed from the inner side 16 of the descender body through either right or left hole 80 or 90 (either work equally well) to the outer side 14. Using right hole 80 as the illustrative example, a segment of the free end of the rope is then pulled through the right hole to provide a sufficient length for free end 126. The upper end is then inserted into left hole 90 and passed back from the outer side 14 through the left hole 90 to the inner side, and a length of rope is pulled until a bend 130 is brought into engagement with shelf 70, such that the outer surface of the rope at bend 130 is proud as to the descender body upper side 14 (i.e., disposed above it). The anchor line, comprising the upper end of the anchoring portion of the rope 120, is then passed through payout hole 50 and pulled until a second bend 140 is brought into engagement with channel 98 extending from left hole 90 to the payout hole 50. The upper end is then tied to an anchor device 124.

When so configured, (see FIGS. 6, 8, 10), when under a load, the safety line pays out controllably and increasingly freely when the user pulls the handle bar down into a generally horizontally orientation, and the safety line is brought into increasing alignment with the central axis of the payout hole 50. When under a load, if handle 28 is not pulled downwardly by the user, the device will remain in a generally vertical orientation (vertical as to its longitudinal axis 56), and bend 130 is thereby automatically brought into contact with anchor line 120, thus causing the device to automatically brake. The anchor hole 60 is sized very slightly smaller than the selected rope diameter, thus in this vertical orientation, the safety line is prevented from free pay out and maintains alinement of the anchor portion of the line onto bend 130, allowing a slow pay out under anticipated loads (comprising typical body weight with gear) simply by pulling down on the handle. Then, if and as the user wishes to slow, he controls the angle of the handle and tips it up accordingly. If he then wishes to come to a complete stop in the descent, he/she simply allows the handle bar 28 to tip freely up, which is accomplished using the force of the load only. This brings the safety line fully into the anchor hole and further brings the anchor line 120 into engagement with bend 130 to prevent further rope pay out, automatically.

What is claimed as invention is:

1. A descent device, comprising:

a body having an outer side and an inner side an upper side a lower side, a right side, and a left side;

an elongate handle integrally affixed to and extending from an inner portion of said upper side of said body, said handle and said body having a common longitudinal axis;

an attachment lug disposed on an outer portion of said body for attachment to a rope or lanyard;

a payout hole disposed through said body from said inner side to said outer side and having a central axis on and normal to said common longitudinal axis;

an anchor hole disposed above through said body from said inner side to said outer side and having a central axis on and normal to said common longitudinal axis and parallel to the central axis of said payout hole, and wherein a portion of said anchor hole and a portion of said payout hole are conjoined;

right and left holes disposed from said inner side to said outer side, each having a central axis normal to said common longitudinal axis, and configured such that a line drawn between said central axes of said right and left holes is normal to said longitudinal axis; and a shallow channel on said outer side between said right and left holes, and a shallow channel between each of said right and left holes and said anchor hole on said inner side, such that a rope disposed between said right and left holes on said outer side is constrained to remain in said shallow channel and bends proud between said right and left holes;

wherein said payout hole, said anchor hole, and said right and left holes are configured for selective payout and locking of a rope passed through said through holes.

2. The descent device of claim 1, wherein said right and left holes each include a chamfered upper opening to induce gentle bends in rope.

3. The descent device of claim 1, wherein the central axes of each of said payout hole, anchor hole, and right and left holes are oriented generally normal to said inner and outer sides.

4. The descent device of claim 1, wherein said payout hole is surrounded by a chamfer at its opening on said outer side of said body, so as to define a bend in rope disposed through the payout hole.

5. The descent device of claim 1, wherein said anchor hole has an upper end with a chamfered opening that terminates in a shallow arcuate shelf formed at a depth from an upper surface of said outer side such that rope threaded through said anchor hole will bend proud across said shallow arcuate shelf in relation to said outer side.

6. The descent device of claim 1, wherein said right and left holes have chamfered lower openings at said inner side of said body.

7. The descent device of claim 1, wherein said body and said handle are confined so as to create a clearance space between a climbing rope and said handle when a load is suspended from said attachment lug.

8. The descent device of claim 7, wherein said clearance space spans a distance from an upper edge of said body and an outer side of said handle.

9. The descent device of claim 1, wherein said handle is integral with said upper side of said body.

10. The descent device of claim 1, wherein an inner side of said handle is flat and is generally coplanar with said inner side of said body.

11. The descent device of claim 1, wherein said attachment lug is integral with said outer portion of said lower side of said body.

12. The descent device of claim 1, wherein said payout hole, said anchor hole, and said right and left through holes are configured to create a combination of through holes having a threading pattern for passing a safety line through said through-holes that enables a user to selectively lock or pay out safety line in a controlled manner when executing a descent.

13. The descent device of claim 12, having an automatic locked configuration when said longitudinal axis is in a generally vertical orientation, a free payout configuration when said longitudinal axis is in a generally horizontal orientation, and a controlled payout configuration when said longitudinal axis is between a generally vertical and a generally horizontal orientation.

14. The descent device of claim 12, wherein said threading pattern includes passing a safety line upper end through either of said right or left hole from said inner side to said outer side, passing the safety line upper end back through the other of said right or left hole from said outer side to said inner side so as to create a bend standing proud relative to said outer side from said right to said left hole, passing the safety line upper end from said inner side through said payout hole to said outer side so as to create a bend from either of said right or left hole to said payout hole, and pulling a sufficient length of the upper end of the safety line to connect to an anchoring device.

* * * * *